US009719506B2

(12) United States Patent
Kamal et al.

(10) Patent No.: US 9,719,506 B2
(45) Date of Patent: Aug. 1, 2017

(54) DIVIDED STATOR CASING

(71) Applicant: NETZSCH PUMPEN & SYSTEME GMBH, Selb (DE)

(72) Inventors: Hisham Kamal, Waldkraiburg (DE); Christian Bindig, Wunsiedel (DE); Stefan Voit, Amerang (DE)

(73) Assignee: NETZSCH Pumpen & Systems GmbH, Selb (DE)

( * ) Notice: Subject to any disclaimer, the term of this patent is extended or adjusted under 35 U.S.C. 154(b) by 351 days.

(21) Appl. No.: 14/533,886

(22) Filed: Nov. 5, 2014

(65) Prior Publication Data

US 2015/0086350 A1 Mar. 26, 2015

Related U.S. Application Data

(63) Continuation of application No. PCT/DE2013/100163, filed on May 2, 2013.

(30) Foreign Application Priority Data

May 5, 2012 (DE) ..... 10 2012 008 761

(51) Int. Cl.
*F04C 2/107* (2006.01)

(52) U.S. Cl.
CPC ..... *F04C 2/107* (2013.01); *F04C 2/1075* (2013.01); *F04C 2230/60* (2013.01); *F04C 2230/70* (2013.01)

(58) Field of Classification Search
CPC .... F04C 2/107; F04C 2/1075; F04C 2230/60; F04C 2230/70
See application file for complete search history.

(56) References Cited

U.S. PATENT DOCUMENTS 3,011,445 A * 12/1961 Bourke ..... F04C 2/1075 417/440
3,912,426 A 10/1975 Tschirky
5,474,432 A * 12/1995 Hulley ..... F04C 2/1075 418/48
7,407,372 B2 * 8/2008 Guidry ..... F04C 15/0003 138/138
8,033,802 B2 * 10/2011 Tekneyan ..... F04C 2/1075 418/152

(Continued)

FOREIGN PATENT DOCUMENTS

DE 10042335 A1 3/2002
DE 10241753 C1 11/2003

(Continued)

OTHER PUBLICATIONS

International Search Report Application No. PCT/DE2013/100163 Completed: Mar. 21, 2014; Mailing Date: Mar. 31, 2014 3 pages.

*Primary Examiner* — Igor Kershteyn
(74) *Attorney, Agent, or Firm* — Whitmyer IP Group LLC

(57) ABSTRACT

A stator for eccentric screw pumps with a stator casing for an elastomer body for accommodating a rotor, the elastomer body being provided with at least one collar, wherein the collar is disposed in a recess between the stator casing and a connection body, wherein the fixing of the elastomer body in the stator casing is to be improved. The stator casing includes for this purpose open cavities, recesses and/or elevations at least at one side on the end face.

18 Claims, 4 Drawing Sheets

(56) References Cited

U.S. PATENT DOCUMENTS

| | | | | |
|---|---|---|---|---|
| 2003/0003000 | A1* | 1/2003 | Shepherd | F04C 2/1073<br>417/410.3 |
| 2006/0029507 | A1* | 2/2006 | Kaiser | B21D 15/03<br>418/48 |
| 2006/0182643 | A1* | 8/2006 | Delpassand | F04C 2/1075<br>418/45 |
| 2008/0304991 | A1* | 12/2008 | Speckert | F04C 2/1075<br>418/48 |
| 2008/0304992 | A1* | 12/2008 | Hooper | F04C 2/1075<br>418/48 |
| 2009/0169364 | A1* | 7/2009 | Downton | B22D 15/00<br>415/118 |
| 2013/0084175 | A1* | 4/2013 | Thomas | F04C 2/1075<br>415/208.1 |
| 2013/0149182 | A1* | 6/2013 | Sreshta | F04C 2/1075<br>418/178 |

FOREIGN PATENT DOCUMENTS

| | | | |
|---|---|---|---|
| EP | 0612922 | A1 | 8/1994 |
| GB | 1255230 | A | 12/1971 |
| GB | 2481226 | A | 12/2011 |
| WO | 2011155312 | A1 | 12/2011 |
| WO | 2012024215 | A2 | 2/2012 |

* cited by examiner

DIVIDED STATOR CASING

FIELD OF THE INVENTION

The invention relates to a stator for eccentric screw pumps with a stator casing for an elastomer body for accommodating a rotor, said elastomer body being provided with at least one collar, wherein the collar is disposed in the recess between the stator casing and a connection body.

BACKGROUND OF THE INVENTION

An eccentric screw pump essentially comprises a screw-shaped rotor mounted rotatably in a stator, which rotor rotates with its longitudinal axis eccentrically around the stator axis. The side of the stator facing the rotor comprises an at least double-lead helix having a double pitch and corresponding to the rotor shape. A plurality of chambers of equal size arises between the rotor and the stator, in which chambers the delivered material, on account of the different pitches of the rotor and the stator, is moved in its axial direction through the stator. The rotor is usually made from a low-abrasion material such as steel for example, and the stator is made from an elastic material, such as rubber for example.

The elastomer body is often provided in practice with a casing, the stator being vulcanised for example into the casing. On account of its material, the stator is subject to a comparatively high degree of wear, for which reason a replacement of the stator or the stator casing is required at regular intervals. Solutions have repeatedly been sought in the past to keep the maintenance work required for a replacement to a minimum.

An eccentric screw pump with a stator casing is disclosed for example in DE 102 41 753, said stator casing comprising, for the purpose of simplifying the assembly and dismantling of the elastomer body, a stator casing comprising a plurality of segments connected to one another and extending in the longitudinal direction. The longitudinal edges of the segments are constituted in such a way that adjacent segments engage into one another in order to create a form-fit connection capable of being subjected to tensile loads. Furthermore, the segments are constituted in such a way that their sides facing the elastomer body essentially form flat surfaces. A closed casing in a polygonal shape thus arises through the connection of a plurality of segments. This polygonal shape engages in a corresponding polygonal shape of the outer side of the elastomer body, so that a form fit results for the transmission of the torque and a rotational motion of the elastomer body in the stator casing is prevented.

It would however be desirable for a stator with a stator casing and an elastomer body to be made available, with which not only a rotational motion of the elastomer body is impeded. Since, during the pump operation, in particular as a result of the delivery motion of the rotor, radial and axial forces also occur which act on the elastomer body, the fixing of the elastomer body should be further improved. A special embodiment is known for example from WO2011/155312, wherein the elastomer body is provided at both its ends with a collar, as a result of which effective sealing of the pump is intended to be achieved. The collar is disposed in a recess between the stator casing and a connection body (connection flange, pump housing). The stator casing and the elastomer body are clamped between the connection flange and the pump body by means of threaded rods, the distance arising between the stator casing and the connection body being smaller than the thickness of the collar, as a result of which the collar is squashed and a sealed connection thus arises between the stator and the connection body. Although the elastomer body is also fixed axially in this way, the radially acting forces in the region of the collar are however taken up solely by the constituted friction-locked connection.

The problem underlying invention, therefore, is to provide a stator casing of the type mentioned at the outset, which enables improved fixing of the elastomer body.

SUMMARY OF THE INVENTION

This problem is solved with the features according to the claims. According to the invention, the stator casing comprises at least at one side, on the end face, open cavities, recesses and/or elevations.

The invention proceeds from the consideration that the fixing of the elastomer body in the stator casing can be improved by the fact that the elastomer body is fixed at at least one end between the stator casing and the connection body by means of an additionally acting connection. The connection should also be able to take up radially acting forces in the collar region and it should be a detachable connection.

This is achieved by the fact that, in its end face pointing towards the collar, the stator casing comprises open cavities and/or recesses. When the collar is pressed against the stator casing, the collar digs in at the end face in the stator casing in such a way that the collar projects into the open cavities or recesses on account of its elastomer properties. A friction-locked and form-fit connection arises between the stator casing and the collar, which connection can also take up radially acting forces. It is also conceivable to provide the collar with projections or depressions corresponding to the shape of the open cavities, recesses or elevations. On the one hand, the formation of a form-fit connection is thus also possible with a relatively low contact pressure and on the other hand particularly straightforward positioning with respect to the opening for the rotor accommodation can be achieved by the fact that the elastomer body can be inserted into the stator casing only in a specific rotational position.

In order to produce the connection according to the invention, the connection body comprises a recess accommodating the collar. The collar projects in the longitudinal direction beyond the stator-side end face of the connection block, so that, when the stator casing is pressed against the collar, the collar is squashed and penetrates into the end-face openings in the stator casing. In order to establish a defined pressure, the stator casing has a specified larger outer diameter than the recess in the connection block. The outer stator casing and the connection block form a stop at the end face. The contact pressure can thus be established, for example using one and the same connection block, by means of a suitably selected collar thickness.

In order to ensure that the collar is pressed against the end face of the stator casing after the assembly of the pump, the distance between the stator casing and the connection body should be smaller than the collar thickness. A shape corresponding to the collar should preferably be selected for the recess in the connection body. The collar is thus able to deviate only in the direction of the stator casing, as a result of which a particularly effective digging-in of the collar into the stator casing is achieved.

In order to arrive at the stator according to the invention, any kind of open cavities, recesses or elevations in the stator are conceivable that are suitable for producing an end-face form-fit connection between the stator casing and the connection body. A simple structure may for example be sufficient, insofar as the collar can dig into the intermediate spaces/elevations formed by the structure. The connection body, in isolation or in addition, can of course also be provided at the end face with open cavities, recesses and/or elevations.

The stator is preferably constituted as a profiled body, as result of which open cavities for the collar are formed at the end face. Such an embodiment would also have the advantage that the stator casing, despite the material saving, would have a sufficiently high strength and rigidity.

In a particularly preferred embodiment, the stator casing has a chamber profile. The chambers can be constituted by an inner stator casing wall surrounding the elastomer body, an outer stator casing wall and partition walls lying between the latter. The partition walls run for example in the longitudinal direction of the stator casing, so that open cavities formed by the chamber structure arise at the end face. After the assembly of the stator, the collar of the elastomer body digs in as a result of penetrating into the chambers on account of the contact pressure against the stator casing. The outer diameter of the collar is selected with a size which is such that the collar at least partially overlaps open chambers at the end face by the fact that the wall thickness of the inner stator casing wall is smaller than the height of the collar.

According to a preferred development, the stator casing is constituted as a longitudinally divided stator casing comprising at least two partial shells. A particularly straightforward assembly is thus achieved, since the replacement of the elastomer body can take place in a particularly straightforward manner as a result of the longitudinally divided design of the stator casing. For this purpose, the partial shells are connected to one another detachably.

For example, the partial shells are connected to one another on the one hand by means of a form-fit connection and on the other hand by means of a closure unit. A particularly suitable form-fit connection has been shown to be an embodiment wherein a projecting holding element of a partial shell engages hook-like in a recess of an adjacent partial shell. After the opening of the closure unit, the stator casing can be swung open around the form-fit connection and the partial shells can thus easily be taken off from the elastomer body.

The closure unit is particularly preferably constituted as a quick-action closure, in particular as a kind of screw-snap closure. With the aid of the snap closure, the partial shells can be connected to one another and therefore can close the stator casing. The additional screw connection serves in particular to close a gap between the partial shells.

The closure unit can also be provided with a loss prevention device in order to prevent closure elements becoming detached from the stator casing. An accommodation for a sensor cable can also be provided in the closure unit. The accommodation is preferably constituted as a cable duct and positioned in such a way that the cable duct exposes the sensor cable when the closure unit is opened. When the sensor is dismantled, the sensor can thus be removed together with the sensor cable in a particularly straightforward manner and the partial shells can be removed.

The advantages achieved with the invention consist in particular in the fact that, in the case of a stator with a replaceable elastomer body, the elastomer body is fixed securely in the stator casing. In particular, a possible movement of the elastomer body caused by the rotational motion is effectively counteracted.

Embodiments of the present invention are explained in greater detail by way of example with the aid of diagrammatic drawings. In the figures:

BRIEF DESCRIPTION OF THE DRAWINGS

Identical parts are provided with the same reference numbers in all the figures.

DETAILED DESCRIPTION OF THE INVENTION

Figure 1:
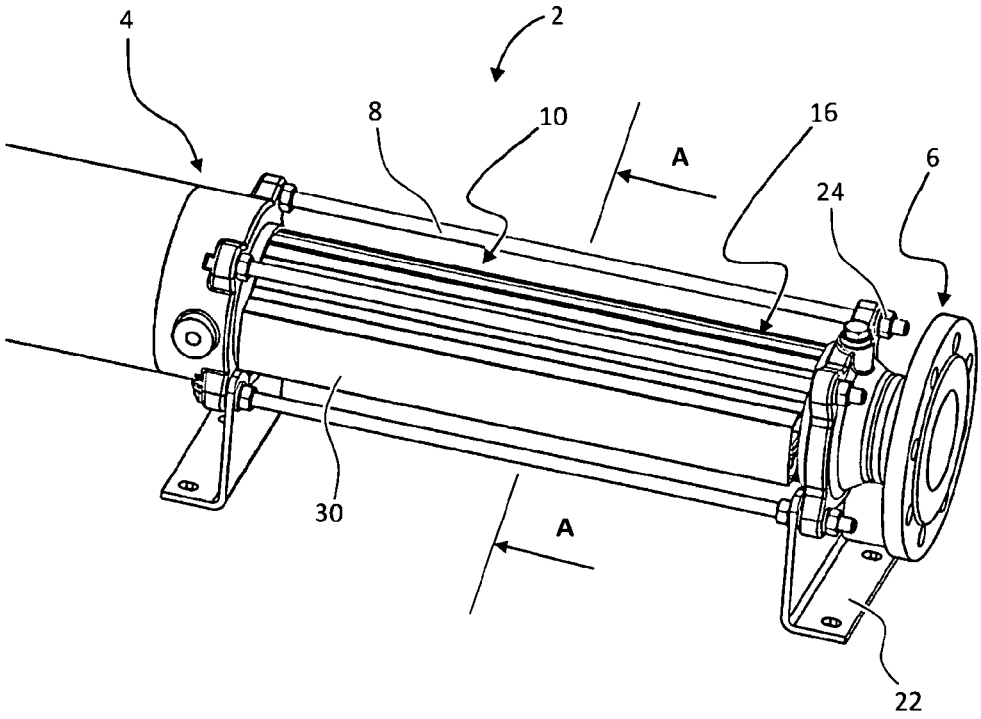
FIG. 1 shows the front section of an eccentric screw pump with a stator clamped between connection bodies.

FIG. 1 represents a front section of an eccentric screw pump 2 with a stator 10 clamped by means of threaded rods 8 between the closure bodies, housing 4 and connection flange 6. Stator 10 comprises a longitudinally divided stator casing 16, comprising two partial shells 12, 14, for an elastomer body 20 for accommodating a rotor, said elastomer body being provided with at least one collar 18. Stator casing 16 is produced from an aluminium alloy.

Eccentric screw pump 2 is provided with two support feet 22 for assembling pump 2 on a pumping station provided for the purpose. With the aid of threaded rods 8, by tightening up threaded nuts 24, collar 18 is clamped between stator casing 16 and connection body 4, 6 to an extent such that stator casing 16 abuts against connection body 4, 6. The two partial shells 12, 14 are connected to one another on the one hand by means of a form-fit connection 26 and on the other hand by means of a closure unit 28. Closure unit 28 is located beneath a protective cover 30.

Figure 2:
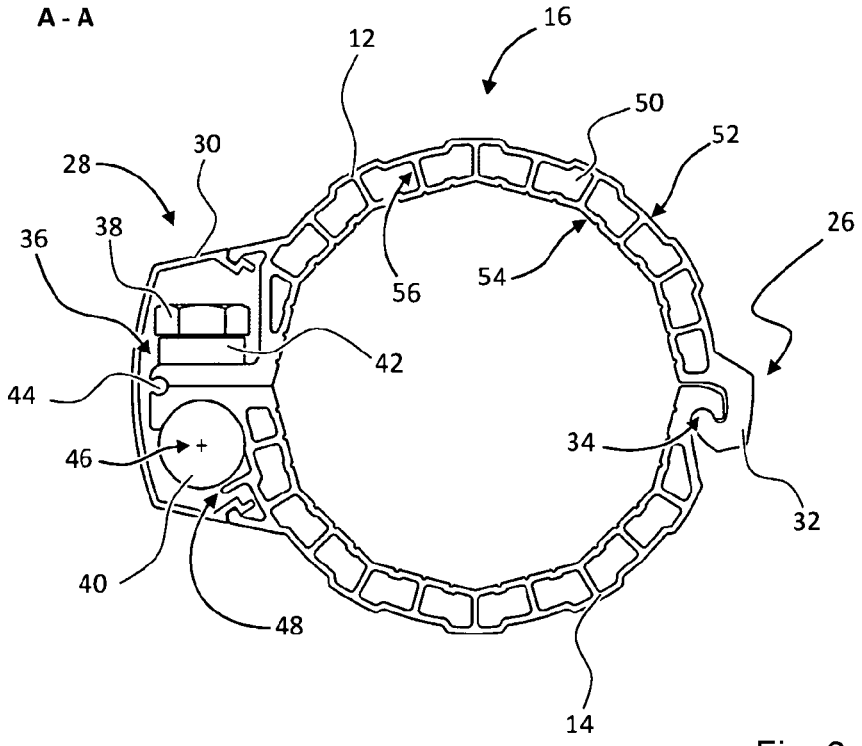
FIG. 2 shows the cross-section of the two-part stator shown in FIG. 1, FIGS. 3, 4, 5 show various embodiments of the closure unit.

FIG. 2 represents a cross-section of two-part stator 10 shown in FIG. 1. Stator 10 has a polygonal inner side and comprises an upper partial shell 12 and a lower partial shell 14, which are connected to one another on the one hand over the entire stator casing length by means of a form-fit connection 26 and on the other hand by means of an opposite-lying closure element 28 acting over the entire stator casing length. Form-fit connection 26 is constituted by a hook-shaped holding element 32 integrally moulded at one end of upper partial shell 12, said holding element engaging in a depression 34 introduced at the opposite end of lower half-shell 14. Disposed opposite form-fit connection 26 is closure unit 28, which represents a kind of screw-snap connection 36. The ends of partial shells 12, 14 run radially outwards on this side of stator 10 and are provided with bores for a fastening screw 38 introduced from above, said fastening screw being screwed into a link rod 40 provided with an internal thread. Disposed between the screw head and upper partial shell 12 is an intermediate plate 42 provided with through-bores, said intermediate plate serving in particular to distribute the forces acting during the screwing.

A recess is introduced into the two partial shells 12, 14 at the end face of the radially running ends of partial shells 12, 14, said recesses forming a cable duct 44 for a sensor. This cable duct 44, on account of the special arrangement, opens during the dismantling of partial shells 12, 14. The dismantling essentially takes place by the fact that fastening screw 38 is loosened to an extent such that the latter, together with intermediate plate 42, can be folded away from stator 10 around rotational axis 46 of link rod 40. Closure unit 28 is thus opened and partial shells 12, 14 can be unfolded around form-fit connection 26 and removed. The assembly of partial shells 12, 14 takes place in an analogous manner in the reverse order.

Partial shells 12, 14 are connected to one another by means of a plurality of such screw-snap connections 36. Fastening screws 38 can however be folded away from stator 10 in a work cycle, since the latter are coupled with one another by threaded rod 40 and intermediate plate 42. In order that the closure elements cannot fall out of the accommodation introduced into lower partial shell 14 after the folding-open, a loss prevention device 48 constituted as a radially running web is disposed beneath threaded rod 40. In order to protect closure unit 28 against soiling, protective cover 30 fitted on stator 10 is provided by means of snap closures.

As can also be seen from FIG. 2, stator 10 comprises a chamber profile. Chambers 50 are constituted by an outer stator casing wall 52, an inner stator casing wall 54 and partition walls 56 running between the latter along stator 10. Chambers 50 represent, according to the invention, open cavities into which collar 18 of elastomer body 20 can dig in.

Figure 3:
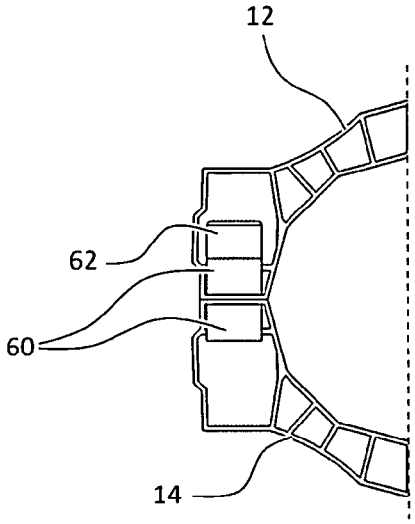
Figure 4:
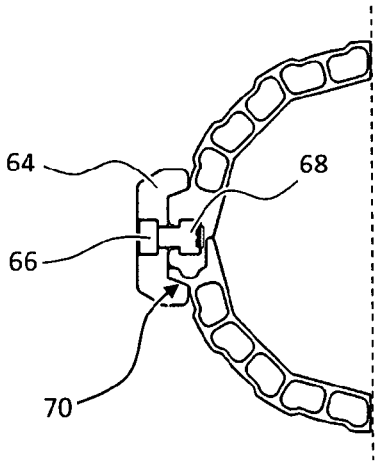
Figure 5:
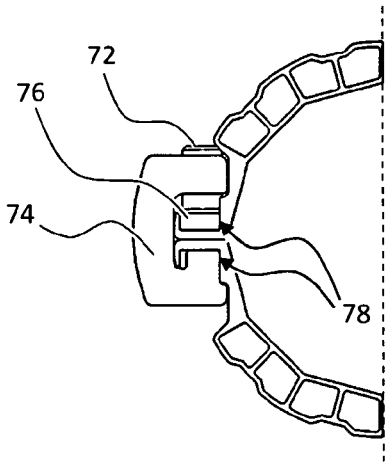

FIGS. 3, 4 and 5 show various embodiments of the closure unit. Thus, FIG. 3 represents a closure unit wherein screwing of stator casing 16 takes place by means of clamping strips 60, which can be pushed into stator casing 16. In this embodiment, an opening in upper partial shell 12 smaller than the screw head serves as a loss prevention device for fastening screws 62, so that screw 62 can become unscrewed via the opening (not represented here) only as far as is possible inside stator casing 16, i.e. until the screw head abuts against the inner side of upper partial shell 12. A part of fastening screw 62 is still located inside clamping strip 60, so that screw 62 does not fall into the profile interior.

FIG. 4 represents a closure unit 28, wherein a closure of partial shells 12, 14 takes place by means of a closure strip 64, which is drawn up to stator casing 16 by means of a fastening screw 66 and a threaded nut 68 integrated into upper partial shell 12 and as a result of which the two partial shells 12, 14 are closed on account of conically running contact faces 70.

A closure unit 28 with pressure screws 72 is represented in FIG. 5. A strip 74 formed into a U-profile serves as a closure strip, said strip being provided with an internal thread for pressure screw 72. For the distribution of the pressure force, a steel strip 76 is pushed as an intermediate plate into upper partial shell 12, 14. The two partial shells are provided with a longitudinally running groove-shaped recess 78 for accommodating steel strip 76 and guiding U-profile strip 74.

Figure 6:
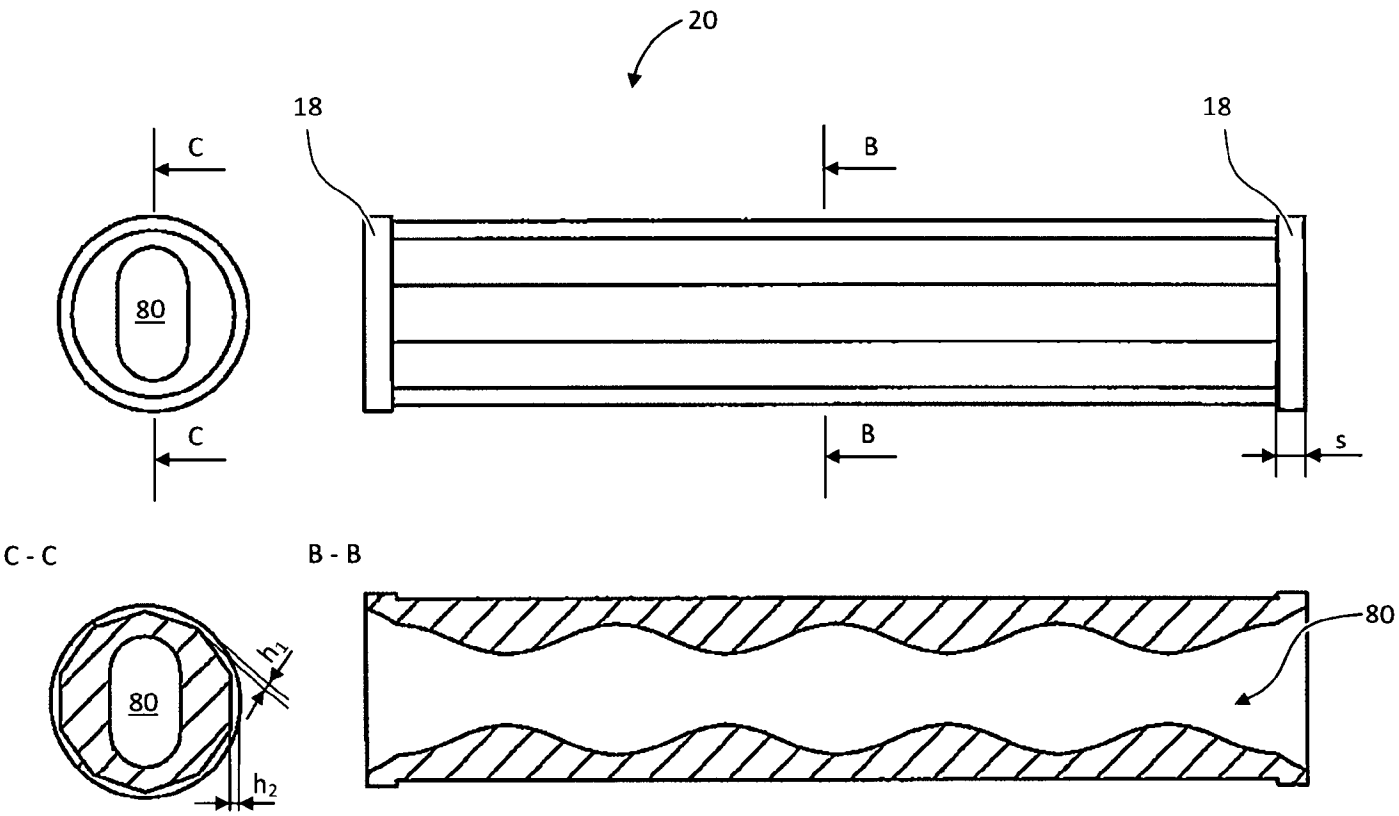
FIG. 6 shows the elastomer body provided at both ends with a collar, said elastomer body having a polygonal outer side.

FIG. 6 shows, in a cross-section and a longitudinal section, elastomer body 20 made in a rubber-like material provided with a collar 18 at both ends, said elastomer body having a polygonal outer side. Collar 18 has a collar thickness s and a collar height $h_1$, $h_2$. Elastomer body 20 comprises a double-lead helical recess 80 for accommodating the rotor.

When eccentric screw pump 2 is assembled, collar 18 first projects out of connection body 4, 6, since collar thickness s is greater than depth d of the recess in connection body 4, 6. Only after the clamping of stator 10 between connection bodies 4, 6 is the collar pressed into the recess in connection body 4, 6, until stator casing 16 then abuts against connection body 4, 6 in the assembled state of pump 2. Collar 18 is pressed into open chambers 50 of stator casing 16 at the end face, which leads to digging-in of collar 18 and therefore also to improved fixing of elastomer body 20 in stator casing 16.

On account of the polygonal cross-sectional shape of elastomer body 20, different collar heights with $h_1<h_2$ result over its circumference. Effective digging-in into stator casing 16 is achieved by the fact that collar 18 has a height $h_1$ which is greater than the wall thickness of inner stator casing wall 54. In order to arrive at the improved fixing of elastomer body 20 according to the invention, at least a collar height $h_2$ has to be selected that is greater than the wall thickness of inner stator casing wall 54. The purpose of greater collar height $h_1$, $h_2$ is that collar 18 projects radially over inner stator casing wall 54, as result of which collar 18 digs in firmly into inner stator casing wall 54. Partition walls 56 in stator casing 16 likewise lead to an additional fixing of collar 18, which counteracts a rotational motion of collar 18.

Figure 7:
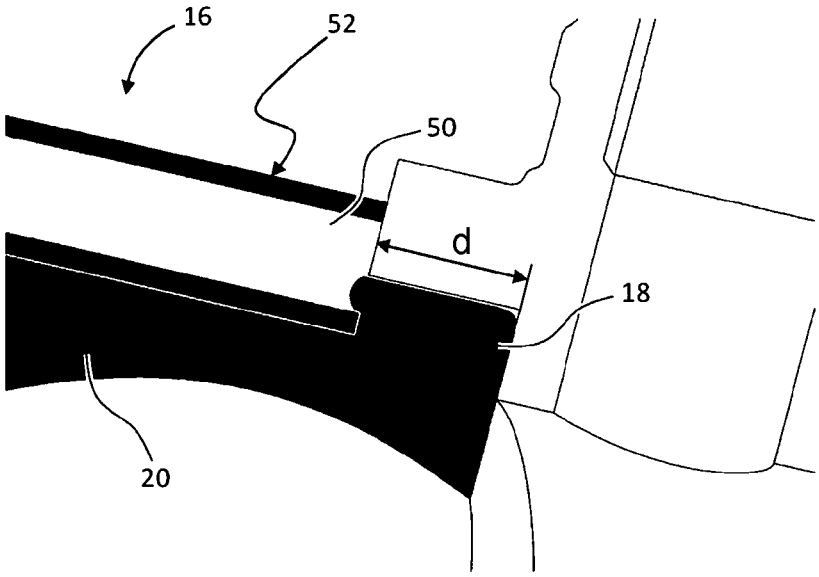
FIG. 7 shows a magnified detail of the clamped stator in the region of the stator/connection body connection, in a longitudinal cross-section representation.

FIG. 7 shows a magnified detail of clamped stator 10 in the region of the stator/connection body connection, in a longitudinal cross-sectional representation. Closure body 4, 6 comprises a recess accommodating collar 18 and has a shape corresponding to collar 18. Depth d of the recess is smaller than collar thickness s, so that collar 18, which projects over inner stator casing wall 54, is pressed into chamber 50. Outer stator casing wall 52 and a part of partition wall 56 abut against the end face of closure body 4, 6, as a result of which a defined force acts on collar 18, which leads to the penetration of shoulder 18 into open chamber 50 of stator casing 16.

Eccentric screw pump 2 is specifically designed for an effective and reliable operation of the pump, wherein stator 10 can be assembled and dismantled in a straightforward manner. In order to be able to fix elastomer body 20 particularly securely in stator casing 16, stator casing 16 comprises open cavities 50, recesses and/or elevations at least at one side on the end face. Digging-in of collar 18 of elastomer body 20 thus occurs, as a result of which an additional friction-locked and form-fit connection between collar 18 and stator casing 16 is achieved.

LIST OF REFERENCE NUMBERS

2 eccentric screw pump
4 pump housing
6 connection flange
8 threaded rod
10 stator
12 upper partial shell
14 lower partial shell
16 stator casing
18 collar
20 elastomer body
22 support foot
24 threaded nut
26 form-fit connection
28 closure unit
30 protective cover
32 holding element
34 depression
36 screw-snap connection
38 fastening screw
40 link rod

42 intermediate plate
44 cable duct
46 rotational axis
48 loss prevention device
50 chamber
52 outer stator casing wall
54 inner stator casing wall
56 partition wall
60 clamping strip
62 fastening screw (clamping strip)
64 closure strip
66 fastening screw (closure strip)
68 threaded nut
70 contact face
72 pressure screw
74 U-profile strip
76 steel strip
78 recess

What is claimed is:

1. A stator for eccentric screw pumps comprising:

a stator casing, an elastomer body for accommodating a rotor, said elastomer body being disposed within said stator casing, said elastomer body having at least one collar at one end of said elastomer body, said collar projecting outward away from a longitudinal axis of said elastomer body, wherein the collar is disposed in a recess between the stator casing and a connection body, wherein the stator casing comprises open cavities, recesses and/or elevations at least at one side on an end face of the stator casing, and wherein the collar is configured to be pressed against the end face and project axially into said open cavities, recesses and/or elevations.

2. The stator according to claim 1, wherein a distance between the stator casing and the connection body is smaller than a thickness (s) of the collar.

3. The stator according to claim 1, wherein the stator casing comprises a profiled body.

4. The stator according to claim 3, wherein the stator casing comprises a chamber profile.

5. The stator according to claim 4, wherein a wall thickness of the chamber profile is smaller than a thickness (s) of the collar.

6. The stator according to claim 1, wherein the stator casing comprises multiple parts.

7. The stator according to claim 6, wherein the stator casing is a longitudinally divided stator casing comprising at least two partial shells.

8. The stator according to claim 7, wherein the partial shells are connected to one another detachably.

9. The stator according to claim 8, wherein the partial shells are connected to one another by means of a form-fit connection and by means of a closure unit.

10. The stator according to claim 9, wherein the closure unit comprises a quick-action closure.

11. The stator according to claim 10, wherein the quick-action closure comprises a screw-snap closure.

12. The stator casing for a stator according to claim 1.

13. The stator according to claim 1, wherein said elastomer body comprises a helical recess for accommodating said rotor.

14. The stator according to claim 1, wherein said stator casing comprises an inner casing wall and an outer casing wall, said collar projecting radially outward over said inner casing wall of said stator casing.

15. The stator according to claim 14, wherein said collar projects radially outward below said outer casing wall.

16. The stator according to claim 14, wherein said stator casing comprises a plurality of partition walls which connect said inner casing wall to said outer casing wall, each partition wall extending along a radial axis of said stator casing.

17. The stator according to claim 1, wherein said collar extends a circumference of the elastomer body.

18. The stator casing for a stator, said stator casing comprising:

an interior configured to house an elastomer body for accommodating a rotor, said elastomer body having at least one collar at one end of said elastomer body, said collar extending outward away from a longitudinal axis of said elastomer body, said collar being disposed in a recess between the stator casing and a connection body; and open cavities, recesses and/or elevations at least at one side of said stator casing on an end face of said stator casing;

wherein said open cavities, recesses and/or elevations are configured to receive a portion of said collar projecting axially therein.

* * * * *